US007806236B2

(12) United States Patent
Scholen et al.

(10) Patent No.: US 7,806,236 B2
(45) Date of Patent: Oct. 5, 2010

(54) METHOD OF DISPLAYING A PRODUCT ON A PRODUCT DISPLAY SYSTEM

(75) Inventors: Jonah M. Scholen, Minneapolis, MN (US); Raul S. Romeiro, Ajax, CA (US); Blake Nielsen, Schaumburg, IL (US); Aaron Guiden, Fraserville, CA (US)

(73) Assignee: Target Brands, Inc., Minneapolis, MN (US)

( * ) Notice: Subject to any disclaimer, the term of this patent is extended or adjusted under 35 U.S.C. 154(b) by 29 days.

(21) Appl. No.: 12/269,682

(22) Filed: Nov. 12, 2008

(65) Prior Publication Data

US 2009/0065454 A1 Mar. 12, 2009

Related U.S. Application Data

(62) Division of application No. 10/963,000, filed on Oct. 12, 2004, now Pat. No. 7,467,772.

(51) Int. Cl.
*A47F 7/08* (2006.01)
*A47F 5/02* (2006.01)

(52) U.S. Cl. ..... 186/52; 248/289.31

(58) Field of Classification Search ..... 248/289.11, 248/289.13, 289.31; 186/52, 57; 211/168, 211/169, 163, 165, 169.1
See application file for complete search history.

(56) References Cited

U.S. PATENT DOCUMENTS

| | | | | |
|---|---|---|---|---|
| 0,898,005 | A | | 9/1908 | Rodler |
| 1,386,621 | A | | 8/1921 | Hughes |
| 1,790,495 | A | | 1/1931 | Bates et al. |
| 1,821,024 | A | | 9/1931 | Noble |
| 1,949,017 | A | | 2/1934 | Knupp |
| 2,717,802 | A | | 9/1955 | Martin |
| 2,787,433 | A | | 4/1957 | Slavsky et al. |
| 2,869,732 | A | * | 1/1959 | Ganz ..... 211/55 |
| 2,928,551 | A | * | 3/1960 | Abrams et al. ..... 211/59.4 |
| 2,931,513 | A | | 4/1960 | Cignoli |
| 2,965,237 | A | * | 12/1960 | Wells ..... 211/35 |
| 2,982,419 | A | * | 5/1961 | Shiels ..... 108/59 |
| 2,992,742 | A | * | 7/1961 | Pendergrast, Jr. ..... 108/146 |
| 3,045,831 | A | * | 7/1962 | Pendergrast, Jr. et al. .. 211/59.4 |
| 3,137,251 | A | * | 6/1964 | Pendergrast, Jr. ..... 108/110 |
| 3,151,576 | A | | 10/1964 | Patterson |
| 3,403,789 | A | * | 10/1968 | La Morte et al. ..... 211/150 |
| 3,612,288 | A | * | 10/1971 | Lesley ..... 211/132.1 |
| 3,616,938 | A | | 11/1971 | McAleenan et al. |
| 3,687,090 | A | * | 8/1972 | Butler et al. ..... 108/6 |
| 3,850,401 | A | | 11/1974 | Snediker |
| 3,958,695 | A | | 5/1976 | Allsop et al. |
| 4,006,826 | A | * | 2/1977 | Rich ..... 211/101 |
| 4,114,764 | A | * | 9/1978 | Rich ..... 211/100 |

(Continued)

*Primary Examiner*—Michael Safavi
(74) *Attorney, Agent, or Firm*—Nixon & Vanderhye P.C.

(57) ABSTRACT

A product display includes at least one shelf and a plurality of product displays. The at least one shelf is configured to receive a stack of product packages thereon. The product displays are pivotally mounted, at spaced intervals, along the at least one shelf. In a first position, each product display supports a product generally in front of the stack of product packages on the at least one shelf, and in a second position, each product display is pivotally moved away from a front of the stack of product packages to enable direct access to the stack of product packages.

19 Claims, 6 Drawing Sheets

U.S. PATENT DOCUMENTS

| | | | | |
|---|---|---|---|---|
| 4,168,871 | A * | 9/1979 | Dierkes | 312/324 |
| 4,192,424 | A | 3/1980 | Allsop | |
| 4,566,598 | A * | 1/1986 | Fors | 211/96 |
| 4,805,331 | A | 2/1989 | Boggess et al. | |
| 4,909,464 | A | 3/1990 | Levine et al. | |
| 5,011,029 | A | 4/1991 | Sugasawara et al. | |
| 5,269,580 | A | 12/1993 | Hsiao | |
| 5,352,058 | A | 10/1994 | Munro et al. | |
| 5,465,851 | A * | 11/1995 | Smith | 211/59.1 |
| 5,547,157 | A | 8/1996 | Hsiao | |
| 5,662,301 | A | 9/1997 | Fard | |
| 6,289,618 | B1 | 9/2001 | Kump et al. | |
| 6,336,564 | B1 | 1/2002 | Garnier | |
| 6,612,057 | B2 | 9/2003 | Shoemaker et al. | |
| 2004/0261220 | A1 | 12/2004 | Lowry | |

* cited by examiner

METHOD OF DISPLAYING A PRODUCT ON A PRODUCT DISPLAY SYSTEM

CROSS-REFERENCE TO RELATED APPLICATION

This application is a divisional application of U.S. patent application Ser. No. 10/963,000, filed Oct. 12, 2004, which is incorporated herein in its entirety.

BACKGROUND OF THE INVENTION

Display of clothing apparel and shoes has long been an important part of enticing consumers to purchase merchandise. Many retail stores, particularly department stores, place their inventory alongside the displayed apparel and/or shoes. In some instances, shoes are displayed on or near a shelf, which also contains the inventory of shoes. Accordingly, upon seeing a desired item on display, the consumer can readily grab the same type of item from inventory for purchase. However, because of the location of the displayed shoe at the shelf, the displayed shoe can interfere with access to the items on the shelf.

Accordingly, display of consumer apparel, such as shoes, boots, skates, etc. still present a challenge between achieving a highly-visible mounting near a shelf and providing convenient consumer access to boxes of those items adjacent to the displayed product.

SUMMARY OF THE INVENTION

Embodiments of the invention are directed to a product display system. In one embodiment, the product display system includes at least one shelf and a plurality of product displays. The at least one shelf is configured to receive a stack of product packages thereon. The product displays are pivotally mounted, at spaced intervals, along the at least one shelf. In a first position, each product display supports a product generally in front of the stack of product packages on the at least one shelf, and in a second position, each product display is pivotally moved away from a front of the stack of product packages to enable direct access to the stack of product packages.

BRIEF DESCRIPTION OF THE DRAWINGS

Embodiments of the invention will be described with respect to the figures, in which like reference numerals denote like elements, and in which.

DETAILED DESCRIPTION

In the following detailed description, reference is made to the accompanying drawings which form a part hereof, and in which is shown by way of illustration specific embodiments in which the invention may be practiced. In this regard, directional terminology, such as "top,""bottom,""front,""back, ""leading,""trailing,"etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Embodiments of the present invention are directed to an assembly for displaying a product, such as an in-line skate, that is pivotally mountable to a shelf for movement between a first position adjacent the shelf, and a second position away from the shelf to enable removal of items from the shelf. The assembly is biased to return the displayed product back to the first position. In the first position, this assembly enables the product to be fully viewable outside of its box for quick and convenient examination by a consumer. In its second position, this product display assembly enables both placement of a boxed product on the shelf immediately behind the displayed product and easy removal of the boxed product for further examination and/or purchase by the consumer.

In one embodiment, the product is an in-line skate, which is mounted to the product display assembly at a portion of the skate that permits the wheels of the skate to be turned freely, independent of mounting. This free-spinning mounting feature further entices customer to purchase the item, because of their ability to test and play with the wheels of the skate.

These features, and additional features, of embodiments of the invention are described and illustrated in association with FIGS. 1-11.

Figure 1:
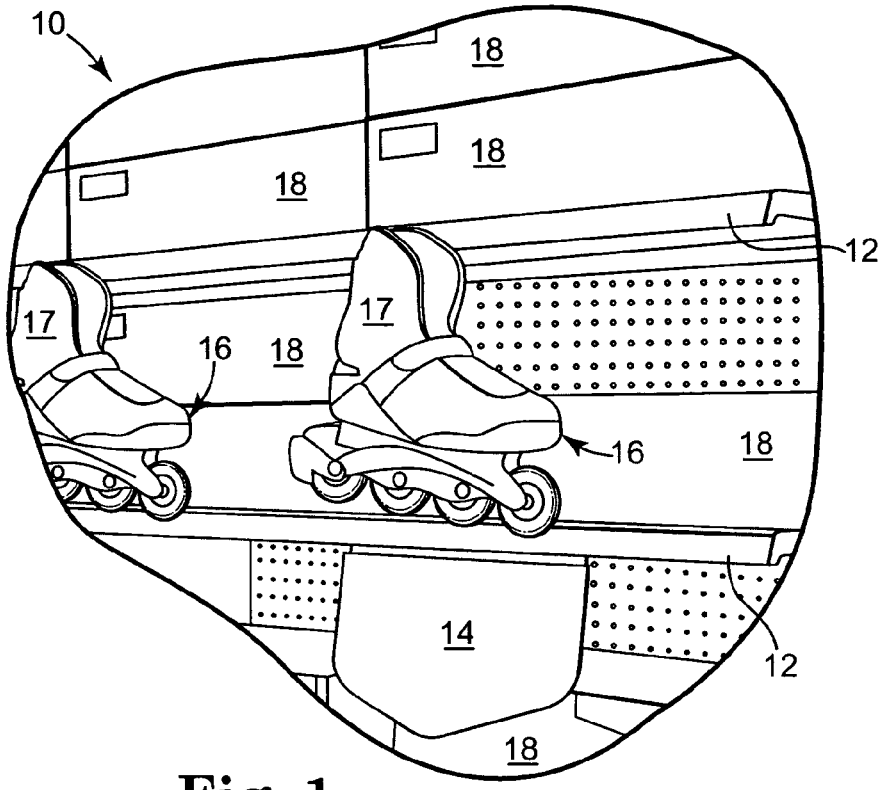
FIG. 1 is a perspective view illustrating a product display system, according to an embodiment of the invention.

FIG. 1 is a perspective view of a product display system 10. As shown in FIG. 1, display system 10 comprises shelves 12, display signs 14, one or more product display(s) 16, and product boxes 18. Each product display 16 supports a single product 17. In one embodiment, product 17 comprises a skate, such as in-line skate. In other embodiments, product 17 comprises boots, shoes, and/or apparel that are configured for mounting substantially similar to an in-line skate. Shelves 12 support boxes 18, with several boxes 18 stacked vertically and arranged side-by-side on each shelf. Product displays 16 are mounted at laterally spaced intervals along a front edge 19 of shelf 12.

As shown in FIG. 1, boxes 18 rest on shelves 12 behind a respective product display 16, which reveals to a consumer the type of product contained in boxes 18 on shelf 12, preferably immediately behind product display 16. Product display 16 enables a consumer to examine the product in detail without having to pull a box of the shelf, and open the box to see the product.

Figure 2:
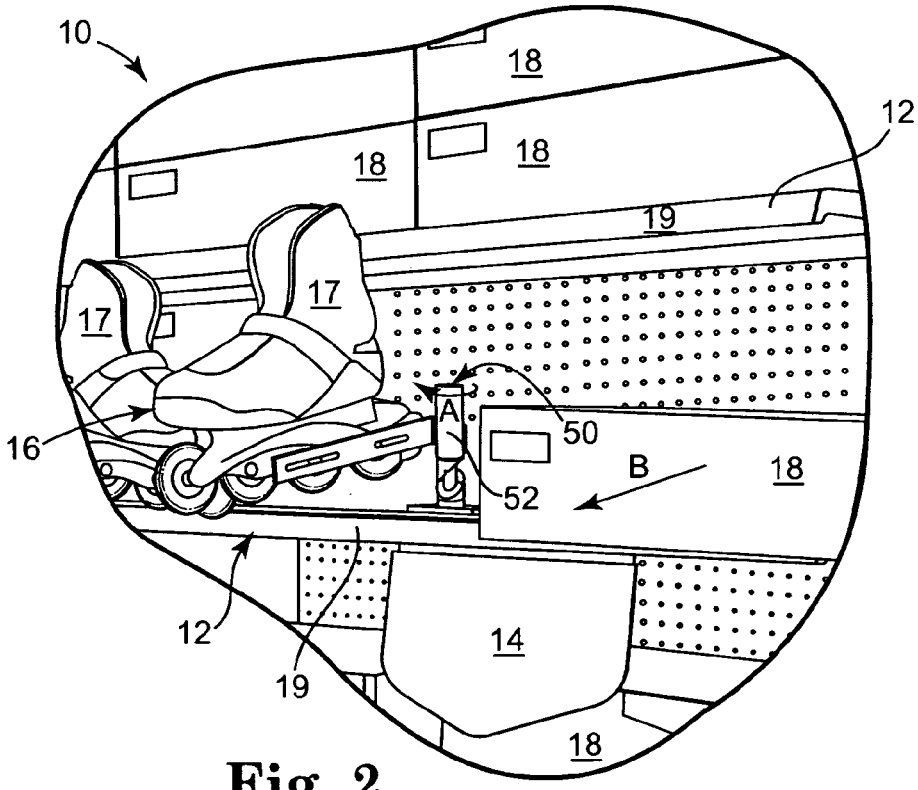
FIG. 2 is a perspective view illustrating a product display system, according to an embodiment of the invention.

FIG. 2 further illustrate product display 16, which comprises product display assembly 50 including biasing mechanism 52. As shown in FIG. 2, product display 16 is pivotally mounted to front edge 19 of shelf 12 via biasing mechanism 52 to enable product display 16 to be pivoted generally outward (shown by directional arrow A) at an angle relative to front edge 19 of shelf 12, thereby enabling access to boxes 18 for unrestricted sliding movement of box 18 relative to product display 16 (shown by directional arrow B). In one embodiment, in the second position product display 16 is generally perpendicular to front edge 19 of shelf 12. In this second, open position, product display 16 permits boxes 18 to either be removed from shelf 12 or placed on shelf 12 without disturbing adjacent product displays 16 along shelf 12 or adjacent boxes on shelf 12. After removal or placement of box 18 relative to shelf 12, the consumer releases their hold on product display 16, at which time biasing mechanism 52 (shown in more detail in FIGS. 3-11) causes product display 16 to pivot back to its rest position (shown in FIG. 1). In one embodiment, the lateral spacing between adjacent product displays 16 on a single shelf is selected to generally correspond to a width of a box 18. In other embodiments, this lateral spacing between adjacent product displays 16 is great enough to enable some boxes 18 to be removed without pivoting of product display 16 and/or adjusting adjacent boxes 18 on shelf 12.

Figure 3:
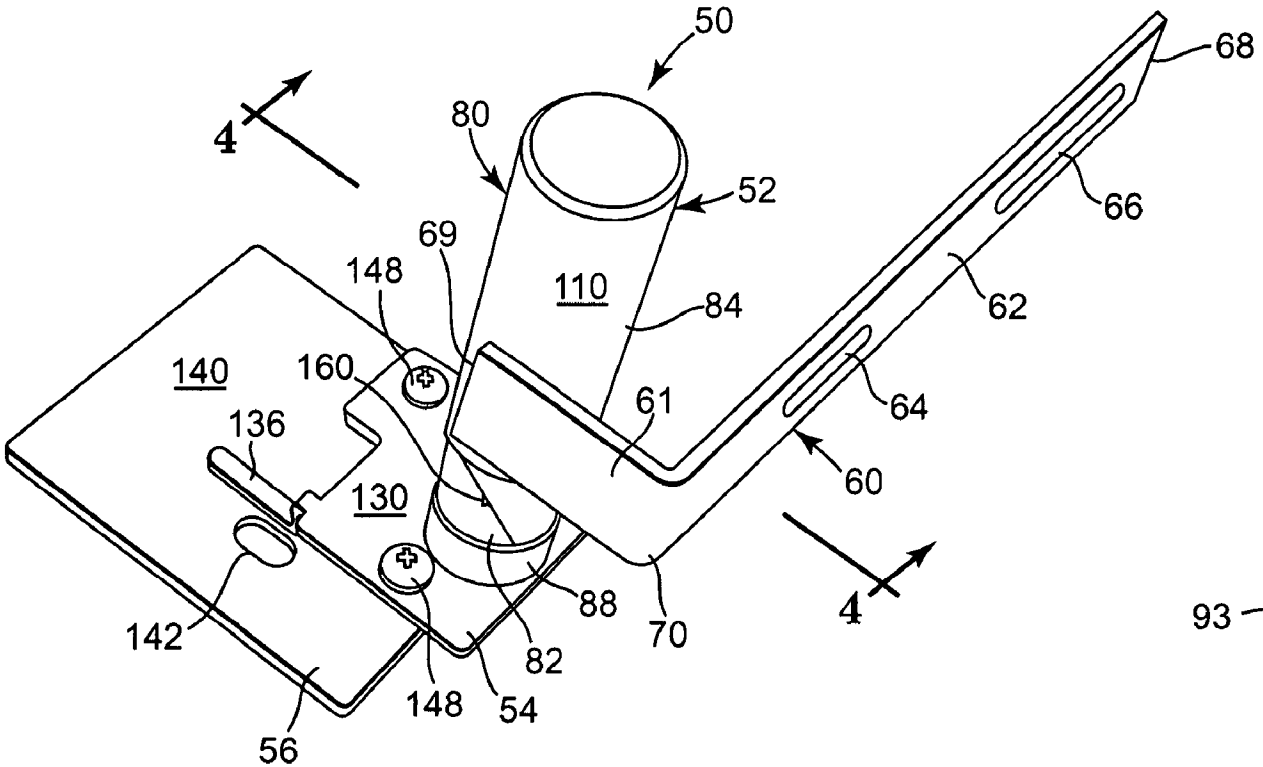
FIG. 3 is a perspective view illustrating a product display assembly, according to an embodiment of the invention.

FIG. 3 is a perspective view of product display assembly 50. As shown in FIG. 3, product display assembly 50 comprises biasing mechanism 52, first plate 54, second plate 56, and product support arm 60.

Product support arm 60 includes first portion 61 and second portion 62. Second portion 62 includes elongated mounting slots 64, 66 and outer end 68 while first portion includes end 69. First portion 61 and second portion 62 of arm 60 are generally perpendicular to each other and together form junction 70.

In one embodiment, mounting slots 64, 66 are sized and shaped for securing a wheel frame portion of an in-line skate 17 onto second portion 64 of product support arm 60. The elongated shape of slots 64, 66 enables the in-line skate to be positioned at variable locations along a length of second portion 64 of product support arm 60. In one embodiment, this variable positioning enables mounting of the in-line skate 17 so that a rear end of skate 17, closest to junction 70 of arm 60 does not swing into contact with front edge 19 of shelf 12 when product arm 60 is pivoted fully to the second open position (as shown in FIG. 2).

As shown in FIG. 3, biasing mechanism 52 is fixed on first plate 54 and extends upward and generally perpendicular to first plate 54. Biasing mechanism 52 comprises pivot 80 including lower portion 82 and upper portion 84. Lower portion 82 comprises first generally cylindrical member 86 mounted in base 88 of first plate 54. Second portion 84 of pivot 80 is adapted to rotate (i.e., pivot) relative to lower portion 82, and comprises among other things, second generally cylindrical member 100 and collar 100. In one embodiment, first and second generally cylindrical members 86, 88 are formed from a polymeric material, such as a polyethylene material, and angled contact surfaces 92, 104 are slidably movable relative to each other. In another embodiment, first and second generally cylindrical members 86, 88 are made from a non-polymeric material. In another embodiment, first and second generally cylindrical members 86, 88 additionally include a coating, such as a polytetrafluoroethylene coating, on angled contact surfaces 92, 104 to facilitate slidable movement relative to each other.

In addition, stop mechanism 160 is formed on or about upper portion 84 and lower portion 82 to enable limiting pivoting of upper portion 84 relative to lower portion 82, as further described and illustrated later in association with FIGS. 5, and 9-11.

First plate 54 is adapted to secure biasing mechanism 50 to shelf 12. As shown in FIG. 3, first plate 54 comprises body 130, holes 134 (shown in FIG. 5), and tab 136 that extends outward from body 130. Tab 136 extends within a plane that is generally parallel to but spaced from the plane in which body 130 extends. Second plate 56 is configured to secure first plate 54 relative to shelf 12, and comprises body 140 with slot 142, and fastening holes 146 (shown in FIG. 5). Mounting of first plate 54 and second plate 56 relative to shelf 12 is further described later in association with FIGS. 6 and 7.

Figure 4:
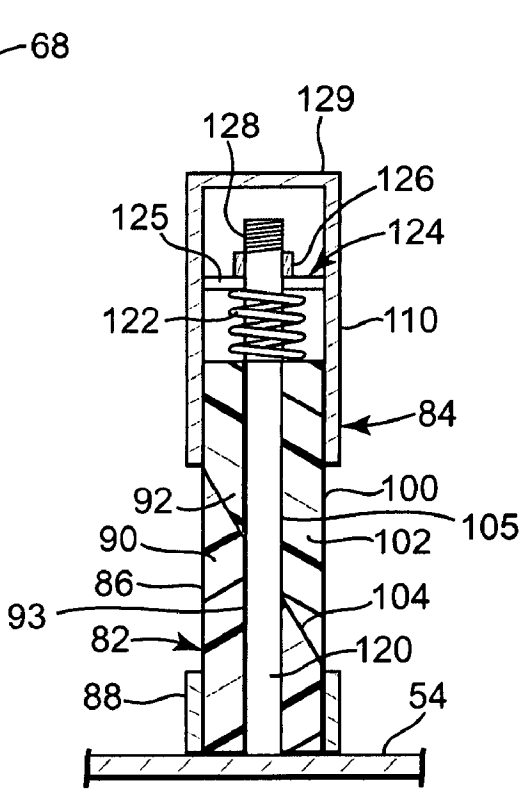
FIG. 4 is a sectional view as taken along lines 4-4 of FIG. 3, according to an embodiment of the invention.
Figure 5:
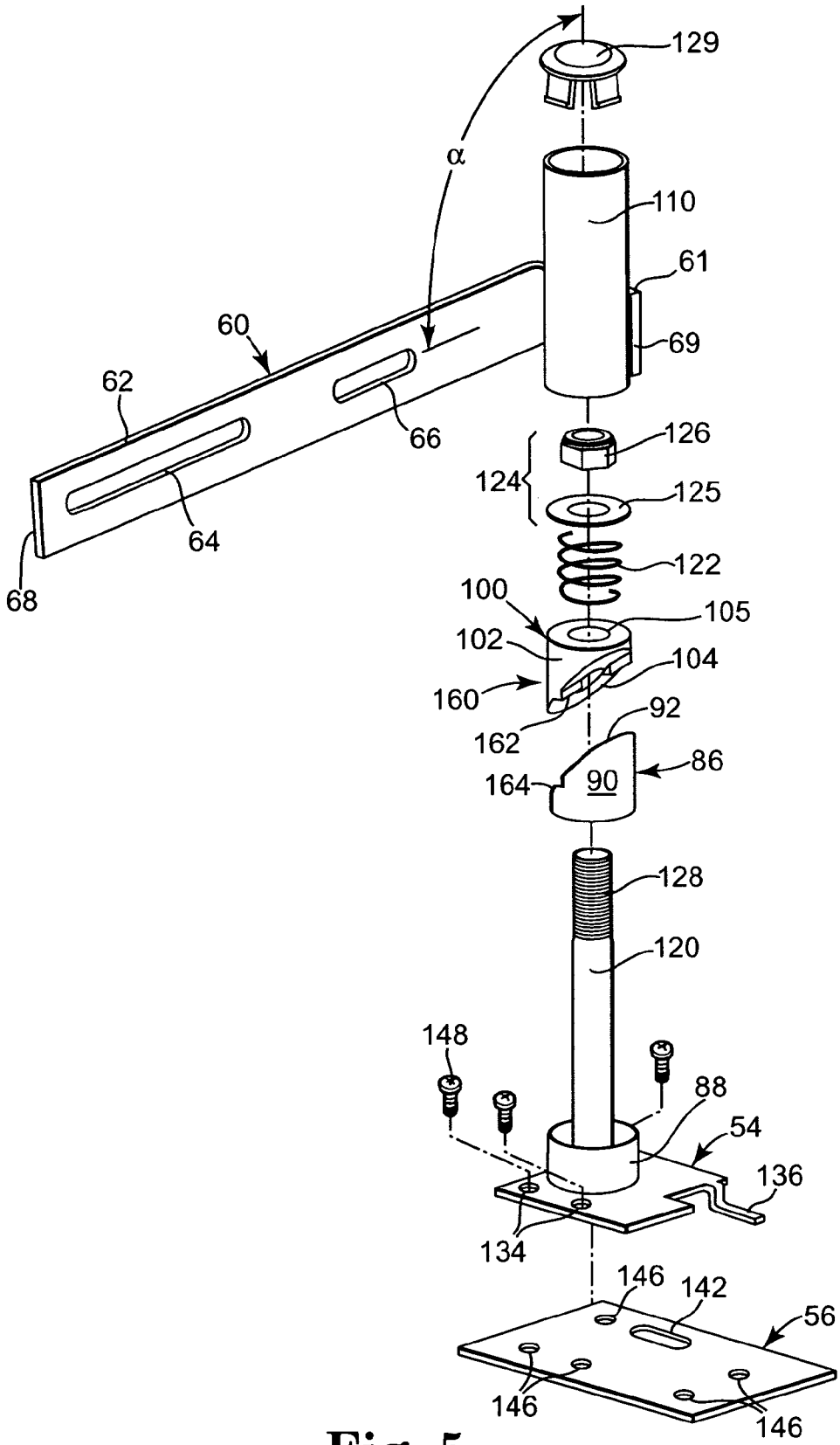
FIG. 5 is an exploded view illustrating a product display assembly, according to an embodiment of the invention.

FIGS. 4 and 5 further illustrate components of biasing mechanism 50 including pivot 80. FIG. 4 is a sectional view of FIG. 3, illustrating lower portion 82 and upper portion 84 of pivot 80 while FIG. 5 is an exploded view of revealing additional aspects of those same components.

As shown in FIGS. 4-5, upper portion 84 of pivot 80 of biasing mechanism 50 comprises additional components such as second generally cylindrical member 100, post 120, spring 122, fastener 124, and cap 129, all of which are housed within or on collar 110. Second generally cylindrical member 100 of upper portion 84 includes body 102, angled contact surface 104, center hole 105. Body 102 of second generally cylindrical member 100 is fixed within collar 100. In addition, FIG. 4 also reveals additional aspects of lower portion 82 of biasing mechanism 50, such as first generally cylindrical member 86 which includes body 90, angled contact surface 92, and center hole 93. Body 90 of first generally cylindrical member 86 is mounted in collar 88.

Post 120 of pivot 80 is fixed to first plate 54 and extends upward from body 130 of first plate 54. Post 120 extends through center hole 93 in first generally cylindrical member 86 of lower portion 82 and through center hole 105 in second generally cylindrical member 100 of upper portion 84 into collar 110. Spring 122 is interposed between body 102 of second generally cylindrical member 100 and fastener 124, which is secured relative to post 120 to exert a downward pressure on spring 122 against second generally cylindrical member 100.

In one embodiment, fastener 124 comprises washer 125, nut 126 and threaded end 128 of post 120. In other embodiments, fastener 124 comprises other fixation mechanisms, such as clamps, rings, etc, fixable on post 120 and/or protrusions or recesses on post 120, capable of maintaining its relative position along a length of post 120 and also exerting a downward pressure on spring 122.

Angled contact surfaces 92, 104 of first and second generally cylindrical members 86, 100 reciprocate each other when lower portion 82 and upper portion 84 are in contact with each other in an at-rest position, as shown in FIG. 4. In one embodiment, each angled contact surface 92, 104 forms an angle of about 45 degrees relative to a horizontal plane that is generally parallel to body 130 of first plate 54. A more detailed explanation of the interaction of angled contact surfaces 92, 104 in the at-rest position, and in a pivoting position, is provided in association with FIGS. 5, and 9-11.

FIG. 5 also illustrates second portion 62 of arm 60 extending from collar 110 downwardly at an angle (.alpha.) relative to a longitudinal axis of collar 110, which results in second portion 82 declining slightly less than a generally horizontal plane. Angle (.alpha.) is selected so that gravitational forces acting on a product, e.g., skate attached to second portion 62 of arm 60 cause further downward pressure on upper portion 84 of biasing mechanism to facilitate the return of arm 60 from a pivoted position (FIG. 2) back to an at rest position (FIG. 1).

FIG. 5 also further reveals stop mechanism 160, which comprises protrusion 162 and stop surface 164, which releasably engage each other to prevent rotation of upper portion 84 relative to lower portion 82 of pivot 80. In one embodiment, protrusion 162 is formed in angled contact surface 104 of second generally cylindrical member 100 of upper portion 84 and stop surface 164 is formed in or on angled contact surface 92 of first generally cylindrical member 86 of lower portion 82. In another embodiment, protrusion 162 and stop surface 164 are reversed so that protrusion 162 is formed in angled contact surface 92 of first generally cylindrical member 86 of lower portion 82 and recess 164 is formed in angled contact surface 104 of second generally cylindrical member 100 of upper portion 84. In one embodiment, stop surface 164 comprises a recess. In other embodiments, stop mechanism 160 comprises other components, such as a pin formed on one of upper portion 84 or lower portion 82, and a stop surface or catch formed on the other portion, so that movement in first rotational direction is limited at a pre-determined point about circumference of pivot 80 by releasable engagement of the pin and stop surface, and movement in a second rotational direction is generally unrestricted when the pin and stop surface are not engaging each other. Details of operation of stop mechanism 160 are further described and illustrated later in association with FIGS. 9-11.

Finally, FIG. 5 illustrates additional interaction of first plate 54 and second plate 56. In particular, holes 134 in first plate 54 are configured for alignment with holes 146 of second plate 56 for mounting first and second plates 54, 56 relative to shelf 12. Fasteners 148 are adapted for used with holes 134 and 146, as described in association with FIGS. 6-7.

Figure 6:
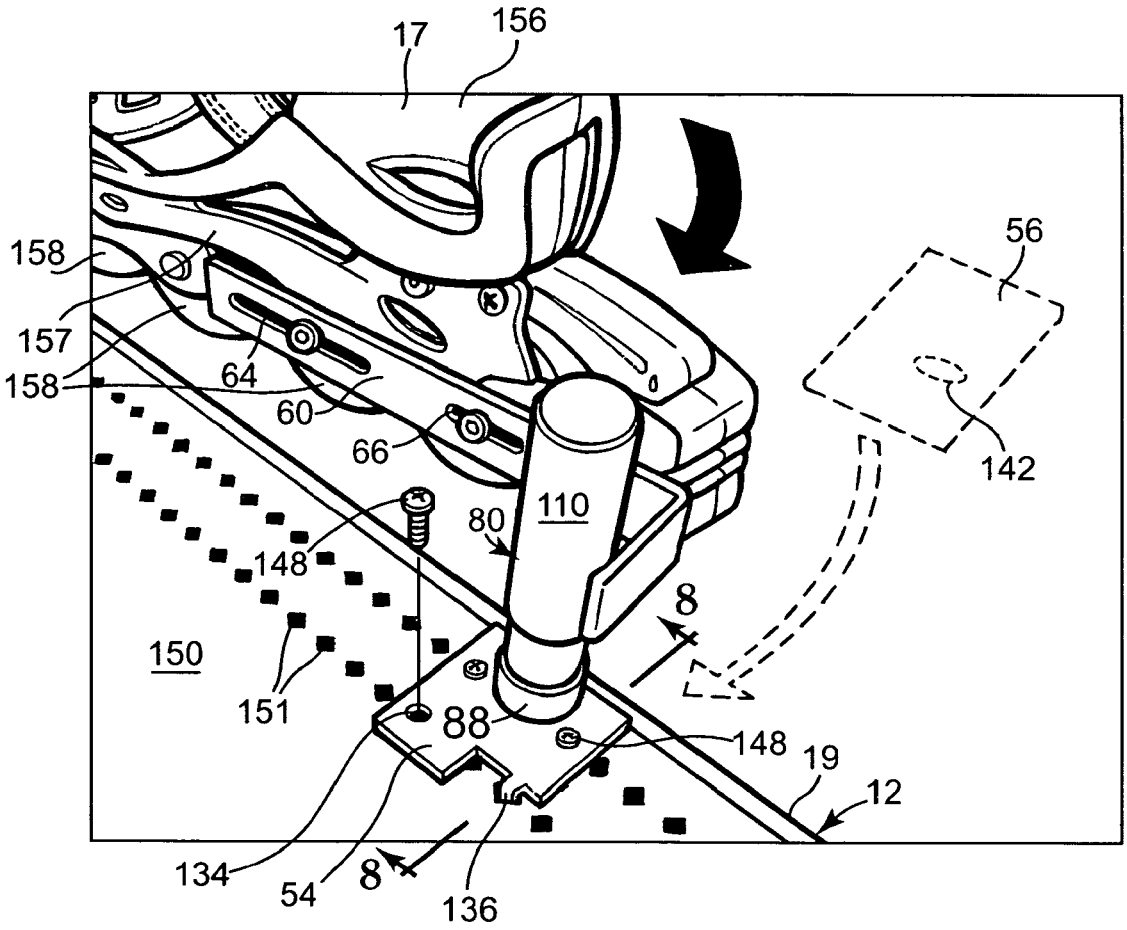
FIG. 6 is a perspective view illustrating installation of a product display assembly on a shelf, according to an embodiment of the invention.
Figure 7:
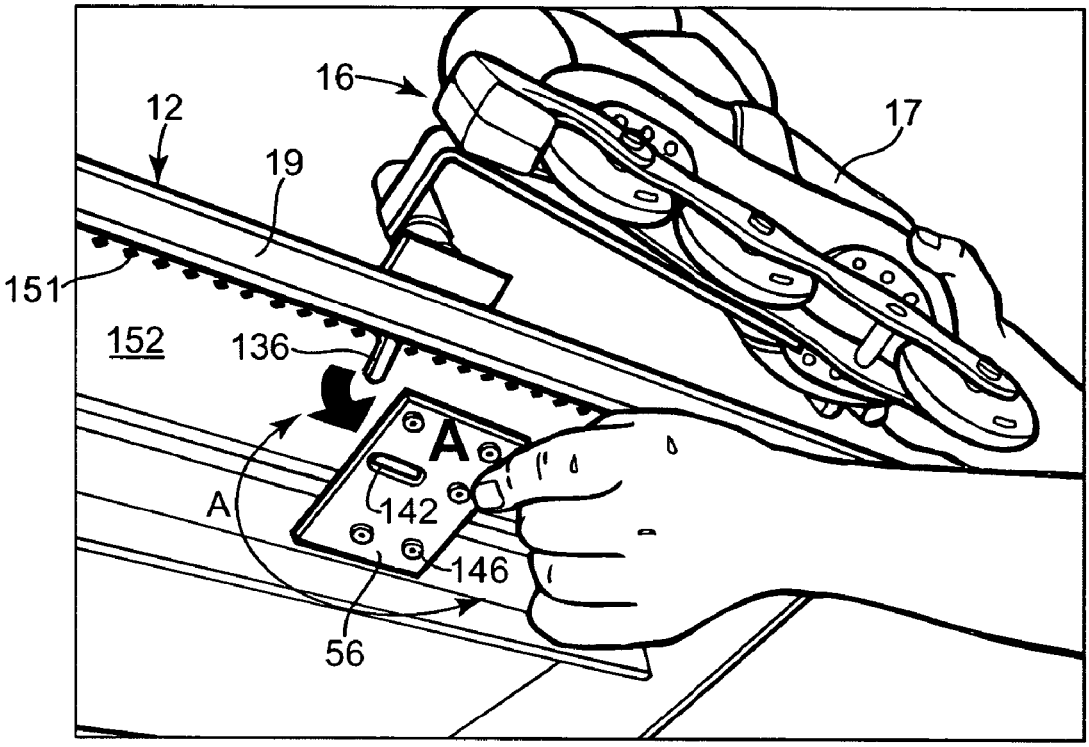
FIG. 7 is a perspective view illustrating installation of a product display assembly on a shelf, according to an embodiment of the invention.

FIGS. 6 and 7 are perspective views illustrating steps in mounting a product display 16 to shelf 12. As shown in FIG. 6, with product 17 already attached to product support arm 60, first plate 54 of product display 16 is positioned adjacent front edge 19 of shelf 12, with holes 134 of first plate 54 aligned over corresponding holes 151 in shelf 12. Tab 136 of first plate 54 is inserted into one of holes 151 of shelf 12 to protrude underneath shelf 12 for engagement with second plate 56. In particular, with first plate 54 positioned over shelf 12, second plate 56 is maneuvered underneath shelf 12, as shown in FIG. 7, until slot 142 of second plate 56 slides over tab 136 of first plate 54, thereby resulting in second plate 54 pressing against a bottom surface 152 of shelf 12 and holes 146 of second plate 56 aligning with holes 134 of first plate 54 and with holes 151 of shelf 12.

Figure 8:
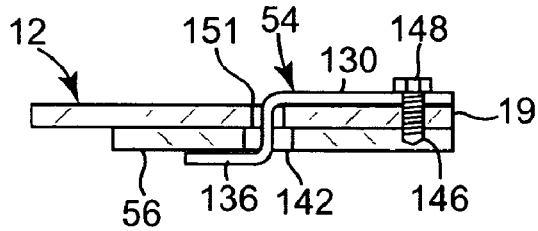
FIG. 8 is a partial sectional view of FIG. 7, according to an embodiment of the invention.

FIG. 8 is a sectional view illustrating first plate 54 and second plate 56 when fully mounted relative to shelf 12. As shown in FIG. 8, tab 136 extends from first plate 54, through holes 151 in shelf 12, and through slot 142 of second plate 56, with tab 136 acting to maintain second plate 56 in pressing contact against bottom surface 152 of shelf 12. Fasteners 148 secure first plate 54, second plate 56 and shelf 12 together. In one embodiment, holes 146 of second plate 56 include a threaded portion for receiving fasteners 148.

In one embodiment, securing holes 146 of second plate 56 are arranged to enable use of a single second plate in multiple orientations relative to shelf 12 to accommodate different patterns of holes 151 in shelf. In one example, one combination of securing holes 146 on second plate 56 are arranged to match up with rows of holes 151 on shelf 12, and correspond to slot 142 extending generally parallel to front edge 19 of shelf 12 (as shown in FIG. 7). In another example, second plate 56 is rotated 90 degrees before mounting (as represented by directional arrow A), to enable securing holes 146 to match up with rows of holes 151 on shelf 12, which corresponds to slot 142 of second plate 56 extending generally perpendicular to front edge 19 of shelf 12 in the mounted position. Accordingly, the number and configuration of securing holes 146, as well as their position and spacing relative to a position and orientation of slot 142, enable dual use of second plate 56 in two different mounting orientations to accommodate different shelf designs.

As mounted as shown in FIGS. 6-8, second plate 56 provides strength to shelf 12 at front edge 19 to assist shelf 12 in bearing the weight and motion of product display 16. In particular, with frame product display 16 robustly anchored relative to shelf 12, product display 16 is supported for pivoting of product arm 60 without interference from or sagging of shelf 12.

As shown in FIGS. 6-7, product display 16 is mounted onto shelf 12 with product 17, such as a skate or in-line skate, already mounted on product support arm 60. However, in another embodiment, product 17 is attached to product support arm 60 only after product display 16 is mounted onto shelf 12. Similarly, once product display 16 is mounted onto shelf 12, product 17 can be removed from product support arm 60 without removing the remainder of product display 16 from shelf 12.

Finally, as further shown in FIGS. 6-7, in embodiments in which product 17 comprises a skate, support arm 60 is mountable to a wheel frame 157 of skate boot 156 to permit the wheels 158 of the skate to be spun freely while mounted relative to support arm 60, and thereby while mounted relative to shelf 12.

Figure 9:
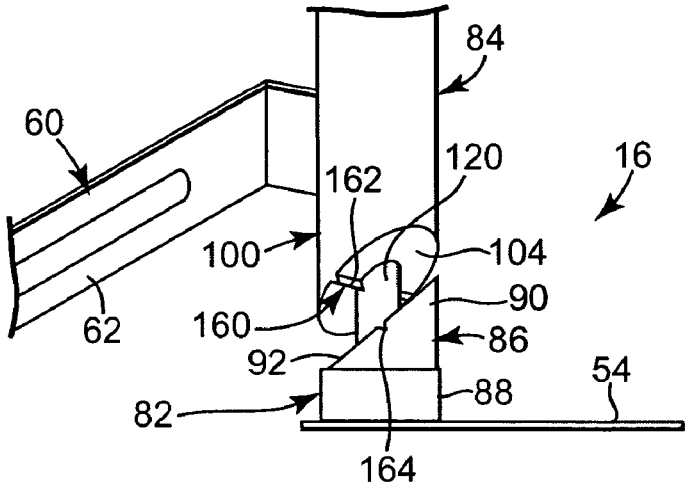
FIG. 9 is a partial side view of a product display assembly illustrating pivotal movement, according to an embodiment of the invention.
Figure 10:
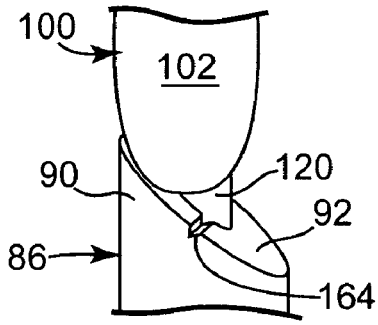
FIG. 10 is a partial side view of a product display assembly illustrating pivotal movement, according to an embodiment of the invention.
Figure 11:
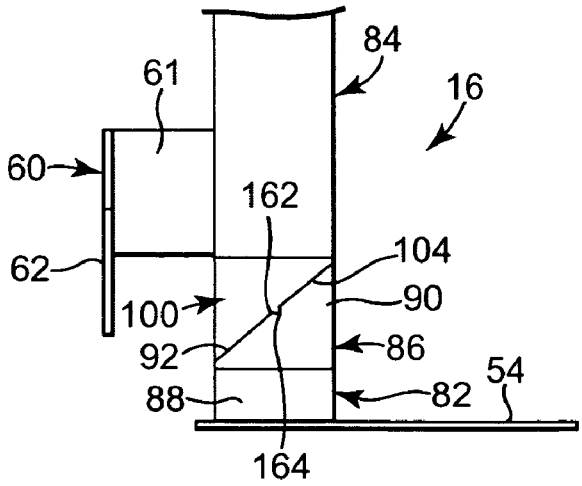
FIG. 11 is a partial side view illustrating a product display assembly, according to an embodiment of the invention.

FIGS. 9-11 illustrate interaction of angled contact surface 92, 104 of lower portion 82 and upper portion 84, respectively, as well as operation of stop mechanism 160. FIG. 11 corresponds to an at-rest, first position of product arm 60 while FIG. 9 corresponds to an open, pivoted second position of product arm 60. For illustrative purposes, pivotal movement of product arm 60 from the first position to the second position is considered movement in a first rotational direction while pivotal movement of product arm 60 from the second position to the first position is considered movement in a second rotational direction.

FIG. 9 is a plan side view, illustrating product display 16 in a second open position, in which product support arm 60 is pivoted outward from front edge 19 of shelf 12 in a first rotational direction. This second position corresponds to the open position of product display 16 shown in FIG. 2. In this position, several factors combine to urge product arm 60 from the position shown to a rest position, which is shown in FIG. 10 (also corresponding to FIG. 1). First, a gravitational force on the weight of product 17 and product arm 60 tends to cause angled contact surface 104 of upper portion 84 to slidably rotate turn relative to angled contact surface 92 of fixed lower portion 82. Accordingly, the shape of the angled contact surfaces 92, 104, the slidable surface characteristics of those contact surfaces, and gravity all act to urge rotation of upper portion 84 relative to lower portion 82. In addition, spring 122 (shown in FIG. 5) exerts downward pressure on upper portion 84 (due to compression exerted on second generally cylindrical body 100 from spring 122, caused by the position of fastener 124 relative to post 120), which further contributes to push upper portion 84 into downward, rotational sliding movement relative to fixed lower portion 82.

FIG. 9 further illustrates stop mechanism 160, previously described in association with FIGS. 3-5, which limits rotational movement of upper portion 84 relative to lower portion 82 of biasing mechanism 50. In the open position shown in FIG. 9, protrusion 162 of stop mechanism 160 does not engage recess 164, and permits unrestricted rotation of upper portion 84 relative to lower portion 82 in the first rotational direction, and of product arm 60 away from front edge 19 of shelf 12.

FIG. 10 illustrates a partial contact of angled contact surface 104 of upper portion 84 on angled contact surface 92 of lower portion 82, when support arm 60 is in second position.

FIG. 11 is a perspective view illustrating product display 16 in an at-rest position. Product arm 60 (and product 17 mounted thereon) is returned from the second open position to the first, at-rest position upon manual release of product arm 60, which enables the biasing forces (previously described in association with FIG. 9) to cause pivotal movement of the product arm 60 in the second rotational direction. As shown in FIG. 11, stop mechanism 160 acts to limit rotation of upper portion 84 relative to lower portion 82 of pivot, in the second rotational direction, to cause product arm 60 to rest generally parallel to front edge 19 of shelf 12. In particular, protrusion 162 of stop mechanism 160 slidaby fits into recess 164, thereby preventing further rotation of upper portion 84 relative to lower portion 82. Several parameters contribute to stop rotation of product arm 60 by overcoming the biasing force. These parameters include, among other things, the extent to which protrusion 162 is raised from contact surface 104 of upper portion 84, the depth of stop surface 164, as well as a width, length, and shape of the protrusion 162 and recess 164. Each of these parameters can be varied to achieve the desired level of force to counteract the biasing forces, which tend to rotate upper portion 84 relative to lower portion 82.

Embodiments of the present invention are directed to an assembly for displaying a product (such as an in-line skate) that is pivotally mountable to a shelf for movement between a first position adjacent the shelf, and a second position away from the shelf to enable removal of items from the shelf. The assembly is biased to return the displayed product back to the first position. In the first position, this assembly enables the in-line skate to be fully viewable outside of its box for quick and convenient examination by a consumer. In its second position, this product display assembly enables both placement of a boxed in-line skate on the shelf immediately behind the displayed skate and easy removal of boxed skates for further examination and/or purchase by the consumer.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method of displaying a product comprising:

positioning a stack of product packages on a shelf;

coupling a side of a product to an arm such that a bottom of the product is freely suspended from the arm, the product being representative of contents of the stack of product packages;

pivotally mounting the arm to the shelf to support the product on the arm for movement in a substantially horizontal plane between a first position, in which the product is adjacent a front edge of the shelf and extends in front of at least a portion of the stack of product packages, and a second position, in which the product is rotated away from the shelf such that the arm extends generally perpendicularly to the front edge of the shelf and the arm and the product are positioned to allow direct access to the stack of product packages on the shelf, and wherein pivotally mounting the arm to the shelf comprises:

attaching a pivot to the shelf, the pivot including a fixed lower portion removably mountable to the shelf and an upper portion coupled to and supporting the arm, and configuring the fixed lower portion and the upper portion to enable slidable, pivoting interaction between the fixed lower portion and the upper portion; and applying a biasing force to the arm to cause the arm to pivotally move to the first position unless a manual force is applied to overcome the biasing force to pivotally move the arm to the second position.

2. The method of claim 1, wherein applying the biasing force comprises:

exerting a downward pressure on the upper portion relative to the fixed lower portion to maintain engagement of the upper portion relative to the fixed lower portion;

configuring the upper portion relative to the fixed lower portion to urge rotation of the upper portion relative to the fixed lower portion from the second position to the first position.

3. The method of claim 2, wherein pivotally mounting the arm comprises:

substantially preventing pivotal movement of the arm, due to the biasing force, beyond the first position while permitting unrestricted pivotal movement of the arm, against the biasing force, from the first position to the second position.

4. The method of claim 1, further comprising:

pivotally mounting additional rotating arms on the shelf at spaced intervals along a length of the front edge of the shelf, wherein each of the additional rotating arms supports a different product and is configured to move from a closed position, in front of a different corresponding one of a plurality of stacks of packaged products positioned on the shelf, to an open position allowing direct access to an entirety of the different corresponding one of the plurality of stacks of packaged products on the shelf.

5. A method of displaying a product comprising:

positioning a stack of product packages on a shelf;

coupling a product to an arm, the product being representative of contents of the stack of product packages;

pivotally mounting the am to the shelf to support the product on the arm for movement between a first position, in which the product is adjacent a front edge of the shelf and extends in front of at least a portion of the stack of product packages, and a second position, in which the product is rotated away from the shelf such that the arm extends generally perpendicularly to the front edge of the shelf and the arm and the product are positioned to allow direct access to the stack of product packages on the shelf, and wherein pivotally mounting the arm to the shelf comprises:

attaching a pivot to the shelf, the pivot including a fixed lower portion removably mountable to the shelf and an upper portion coupled to and supporting the arm, and configuring the fixed lower portion and the upper portion to enable slidable, pivoting interaction between the fixed lower portion and the upper portion; and applying a biasing force to the arm to cause the arm to pivotally move to the first position unless a manual force is applied to overcome the biasing force to pivotally move the arm to the second position, wherein the product is a skate including a wheel frame portion, and coupling the product to the arm includes securing a side of the wheel frame portion to a side of the arm via two slots defined through the arm such that a bottom of the skate is freely suspended.

6. A method of displaying a product comprising:

coupling a side of the product to a side of an arm such that a bottom of the product is freely suspended from the arm;

pivotally mounting the arm on a shelf to support the product on the arm for movement between a first position in which the product is adjacent the shelf and a second position in which the product is rotated away from the shelf; and applying a biasing force to the arm to cause the arm to pivotally move to the first position unless a manual force is applied to overcome the biasing force to pivotally move the arm to the second position, wherein the arm defines two elongated slots extending longitudinally along the arm, and coupling the side of the product to the arm includes securing the side of the product to the arm via the two elongated slots.

7. The method of claim 6, wherein the product is a skate including a wheel frame portion, and securing the side of the product to the arm includes securing the wheel frame portion of the skate to the arm via the two elongated slots.

8. The method of claim 7, wherein securing the side of the product to the arm includes sliding the skate along the two elongated slots to position the skate such that the skate clears a front edge of the shelf when the arm is moved from the first position to the second position.

9. A method of displaying a product comprising:

coupling a side of the product to a side of an arm such that a bottom of the product is freely suspended from the arm;

pivotally mounting the arm on a shelf to support the product on the arm for movement in a substantially horizontal plane between a first position in which the product is adjacent the shelf and a second position in which the product is rotated away from the shelf; and applying a biasing force to the arm to cause the arm to pivotally move to the first position unless a manual force is applied to overcome the biasing force to pivotally move the arm to the second position.

10. The method of claim 9, wherein in the second position, the arm extends generally perpendicular to the shelf.

11. The method of claim 9, wherein pivotally mounting the arm comprises:

attaching a pivot to the shelf, the pivot including a fixed lower portion removably mountable to the shelf and an upper portion for supporting the arm;

configuring the fixed lower portion and the upper portion to enable slidable, pivoting interaction between the fixed lower portion and the upper portion.

12. The method of claim 11, wherein applying the biasing force comprises:

exerting a downward pressure on the upper portion relative to the fixed lower portion to maintain engagement of the upper portion relative to the fixed lower portion;

configuring the upper portion relative to the fixed lower portion to urge rotation of the upper portion relative to the fixed lower portion from the second position to the first position.

13. The method of claim 12, wherein pivotally mounting the arm comprises:

preventing pivotal movement of the arm, due to the biasing force, beyond the first position while permitting unrestricted pivotal movement of the arm, against the biasing force, from the first position to the second position.

14. The method of claim 9, further comprising:

positioning a stack of product packages on the shelf; and coupling the product to the arm such that the product extends in front of the shelf and the stack of product packages when the arm is in the first position, and the product is positioned to allow direct access to the stack of product packages when the arm is in the second position, and the product is representative of contents of the stack of product packages.

15. The method of claim 9, further comprising:

pivotally mounting additional rotating arms on the shelf at spaced intervals along a length of the shelf, wherein each of the additional rotating arms supports a different one of a plurality of products and is configured to move from a closed position, in front of a different corresponding one of a plurality of stacks of packaged products positioned on the shelf, to an open position allowing direct access to an entirety of the different corresponding one of the plurality of stacks of packaged products.

16. The method of claim 15, wherein pivotally mounting additional rotating arms includes spacing the additional rotating arms from one another a distance substantially equal to a width of the different corresponding ones of the plurality of stacks of product packages.

17. The method of claim 12, wherein configuring the upper portion relative to the fixed lower portion includes providing the upper portion with an upper portion angled surface, and providing the fixed lower portion with a lower portion angled surface, wherein the upper portion angled surface interacts with the lower portion angled surface such that the downward pressure induces rotation of the upper portion relative to the fixed lower portion to move the arm and the product toward the first position.

18. A method of displaying a product comprising:

pivotally mounting an arm on a shelf to support a product on the arm for movement between a first position in which the product is adjacent the shelf and a second position in which the product is rotated away from the shelf; and applying a biasing force to the arm to cause the arm to pivotally move to the first position unless a manual force is applied to overcome the biasing force to pivotally move the arm to the second position, wherein pivotally mounting the arm on the shelf includes:

removably mounting a frame to the shelf, wherein the frame includes a first plate and a second plate, and removably mounting the frame to the shelf includes:

mounting the first plate on a top surface of the shelf, mounting the second plate on a bottom surface of the shelf, the bottom surface of the shelf being opposite the top surface of the shelf, wherein the first plate is releasably secured to the second plate through the shelf.

19. The method of claim 18, wherein:

the first plate comprises a first plate body portion and a tab extending outwardly from the first plate body portion;

the second plate comprises a second plate body portion and a hole;

mounting the first plate on the top surface of the shelf includes securing the first plate body portion to the top surface of the shelf and placing the tab to extend through a hole in the shelf;

mounting the second plate on the bottom surface of the shelf includes securing the second plate body portion to the bottom surface of the shelf such that the tab of the first plate is received by the hole of the second plate.

* * * * *